US009358610B2

(12) United States Patent
Joo et al.

(10) Patent No.: US 9,358,610 B2
(45) Date of Patent: Jun. 7, 2016

(54) DEVICE FOR SUPPORTING MOLTEN METAL CONTAINER

(75) Inventors: Jae-Ho Joo, Gwangyang-si (KR); Sung-Moon Kim, Gwangyang-si (KR); Byung-Uk Lee, Gwangyang-si (KR); In-Suk So, Gwangyang-si (KR)

(73) Assignee: POSCO, Pohang-si (KR)

( * ) Notice: Subject to any disclaimer, the term of this patent is extended or adjusted under 35 U.S.C. 154(b) by 626 days.

(21) Appl. No.: 13/703,968

(22) PCT Filed: Jul. 7, 2011

(86) PCT No.: PCT/KR2011/004977

§ 371 (c)(1), (2), (4) Date: Dec. 13, 2012

(87) PCT Pub. No.: WO2012/005525

PCT Pub. Date: Jan. 12, 2012

(65) Prior Publication Data

US 2013/0087670 A1 Apr. 11, 2013

(30) Foreign Application Priority Data

Jul. 7, 2010 (KR) ..... 10-2010-0065317

(51) Int. Cl.

| | |
|---|---|
| ***B22D 41/06*** | (2006.01) |
| ***B22D 41/04*** | (2006.01) |
| ***C21C 5/46*** | (2006.01) |
| ***C21C 5/50*** | (2006.01) |

(52) U.S. Cl.

CPC ..... *B22D 41/06* (2013.01); *B22D 41/04* (2013.01); *C21C 5/4633* (2013.01); *C21C 5/50* (2013.01)

(58) Field of Classification Search

CPC ..... B22D 41/04; B22D 41/06; C21C 5/50; C21C 5/4633; C21C 5/464; F27B 7/12; F27B 7/26

USPC ..... 266/244, 245, 246, 243, 275, 276, 247, 266/248; 222/604; 248/299.1, 311.2

See application file for complete search history.

(56) References Cited

U.S. PATENT DOCUMENTS

| | | | |
|---|---|---|---|
| 3,831,917 | A | 8/1974 | Moser |
| 4,280,688 | A | 7/1981 | Enkner et al. |
| 4,281,823 | A | 8/1981 | Enkner et al. |

(Continued)

FOREIGN PATENT DOCUMENTS

| | | | |
|---|---|---|---|
| CN | 201165531 | Y | 12/2008 |
| CN | 101717838 | A | 6/2010 |
| DE | 1433501 | A | 1/1969 |

(Continued)

*Primary Examiner* — Scott Kastler
*Assistant Examiner* — Michael Aboagye
(74) *Attorney, Agent, or Firm* — The Webb Law Firm

(57) ABSTRACT

A device for supporting a molten metal container is provided, wherein the device has first and second support units for supporting the weight of the molten metal container in connection with a ring member, taken alone or in combination according to a rotary position. According to one embodiment of the present invention, the device for supporting the molten metal container comprises: a ring member which encloses the outside of a rotatable molten metal container; and first and second support units which are configured to support the weight of said molten metal container in connection with said ring member, taken alone or in combination according to a rotary position of said molten metal container.

8 Claims, 9 Drawing Sheets

(56) References Cited

U.S. PATENT DOCUMENTS

| | | | | | |
|---|---|---|---|---|---|
| 4,426,069 | A | * | 1/1984 | Nagati | 266/246 |
| 5,364,079 | A | * | 11/1994 | Gruber et al. | 266/246 |

FOREIGN PATENT DOCUMENTS

| | | | | | |
|---|---|---|---|---|---|
| EP | 0236135 | A2 | | 9/1987 | |
| GB | 1477052 | | * | 6/1977 | C21C 5/50 |
| GB | 1477052 | A | | 6/1977 | |
| JP | 5071504 | A | | 6/1975 | |
| JP | 5565315 | A | | 5/1980 | |
| JP | 5576011 | A | | 6/1980 | |
| JP | 59-096206 | | | 6/1984 | |
| JP | 62-235411 | | | 10/1987 | |

* cited by examiner

DEVICE FOR SUPPORTING MOLTEN METAL CONTAINER

TECHNICAL FIELD

The present invention relates to a device for supporting molten metal container including first and second support units which support the load of a molten metal container alone or together, in combination with a ring member, according to a rotary position.

BACKGROUND ART

A molten metal container "C", such as a converter, containing molten metal therein, is rotatable. Such a molten metal container (C) may be rotated in one direction or the other direction, or alternately in both directions so as to release molten metal contained therein or so as to remove slag generated in the course of blowing where the molten metal container (C) is a converter.

For this purpose, as illustrated in FIG. 9B, the molten metal container (C) may be rotated about a rotational shaft (A), together with a ring member 20 enclosing the molten metal container (C). The load of the molten metal container (C) should be supported even when the molten metal container (C) is rotated or stationary.

Thus, to support the load of the molten metal container (C) when the molten metal container (C) is rotated or stationary, the molten metal container (C) and the ring member 20 are fixed by disposing a connecting member (R) connected to the molten metal container (C) on the ring member 20, and inserting a fixing member (F) into a connecting member (M) through connected to the ring member 20, as illustrated in FIG. 8A. However, this case needs a relatively large structure.

Also, as illustrated in FIG. 8B, the ring member 20 is provided with a support member 41 of which one end is inserted into the molten metal container (C), and the molten metal container (C) is formed with an insertion hole 42 together with ribs (L) such that the support member 41 supports the load of the molten metal container (C). However, in this case, one-sided wearing of the support member 41 may occur due to a narrow clearance between the support member 41 and the insertion hole 42 and a difference in thermal expansion between the molten metal container (C) and the ring member 20 made of different materials, or cracks may be generated in the support member 41 or the insertion hole 42.

Also, as illustrated in FIG. 9A, the other side of the ring member 20 of which one side is connected to the molten metal container (C) is connected to the molten metal container (C) via a thin plate (S) to thus support the load of the molten metal container (C). However, in this case, when the thin plate (S) is subject to a bending load, the thin plate (S) may be very vulnerable to such a load, and may be damaged due to molten metal released while the molten metal contained in the molten metal container (C) is released to the outside.

In addition, as illustrated in FIG. 9B, a first fixing member 31 provided on the ring member 20 is horizontally or vertically connected to a second fixing member 33 provided on the molten metal container (C) by a link member 32 to thus support the load of the molten metal container (C). However, in this case, when the molten metal container (C) is in a rotated location where the link member 32 connected horizontally is subject to the load of the molten metal container (C), cracks may be generated in a connecting part, especially the connecting part between the first fixing member 31 and the ring member 20. For example, in the case where the molten metal container (C) is a converter, the molten metal container (C) may be alternately rotated in one and the other directions. In this case, since the link members 32 connected vertically are arranged at different intervals, an excessive load may be concentrated on only one of the link members 32. Thus, cracks may be generated in the connecting part.

SUMMARY OF THE INVENTION

The present invention has been made in consideration of at least one of requirements or limitations generated in the conventional device for supporting molten metal container.

An aspect of the present invention is to provide a device for supporting molten metal container that may support the load of a molten metal container with a support unit alone or together with another support unit in combination with a ring member, according to a rotated location of the molten metal container.

Another aspect of the present invention is to provide a device for supporting molten metal container that may stably support the load of a molten metal container without leaning of the load of the molten metal container, regardless of the rotated location.

Another aspect of the present invention is to provide a device for supporting molten metal container that may prevent a crack from being generated in a connecting part or the like due to leaning of the load or a difference in thermal expansion between a molten metal container and a ring member.

Another aspect of the present invention is to provide a device for supporting molten metal container that may stably support a molten metal container even when the molten metal container is alternately rotated in one or the other direction.

A device for supporting molten metal container associated with an embodiment to achieve at least one of the foregoing objects may include the following features.

The present invention is based on including first and second support units that support the load of a molten metal container, alone or together in combination with a ring member enclosing an outside of the molten metal according to rotation of the molten metal container.

According to an aspect of the present invention, there is provided a device for supporting molten metal container including: a ring member enclosing an outside of a rotatable molten metal container; and first and second support units supporting the load of the molten metal container, alone or together in combination with the ring member.

The ring member may be provided with a rotational shaft, and the molten metal container may be rotated about the rotational shaft together with the ring member.

The first support unit may support the load of the molten metal container, alone in combination with the ring member from an upright location of the molten metal container to a first rotation location rotated by a predetermined angle from the upright location, the first and second support units may support the load of the molten metal container, together in combination with the ring member from the first rotation location to a second rotation location rotated by 90 degrees from the upright location, and the second support unit may support the load of the molten metal container, alone in combination with the ring member from the second rotation location to a third rotation location rotated from the second rotation location by a predetermined angle.

For this purpose, the first support unit may include a first fixing member provided on the ring member; a link member of which one side is connected to the first fixing member; and a second fixing member provided on the molten metal container, and connected with the other side of the link member.

Also, a spherical bearing may be provided in a connecting part between the first fixing member and the link member, or to a connecting part between the link member and the second fixing member.

The first fixing member and one side of the link member or the other side of the link member and the second fixing member may be connected by a pin member, and a taper member may be positioned between the first fixing member and the pin member or between the second fixing member and the pin member.

Also, the taper member may be formed integrally with a cover member connected to the first fixing member and the pin member or to the second fixing member and the pin member.

The second support unit may include a support member provided on the ring member; and an insertion hole formed in the molten metal container such that one side of the support member may be inserted, a first clearance and a second clearance formed at an opposite side to the first clearance may be formed between the support member and the insertion hole, and the first clearance and the second clearance may be positioned on an upper side and a lower side of the insertion hole, respectively.

Also, the first clearance may be greater than the second clearance.

As described above, according to the embodiments of the present invention, the device for supporting molten metal container may support the load of the molten metal container with a support unit alone or together with another support unit in combination with the ring member.

According to another embodiment of the present invention, the device for supporting molten metal container may stably support the load of the molten metal container without leaning of the load of the molten metal container regardless of rotated location.

According to another aspect of the present invention, the device for supporting molten metal container may prevent a crack from being generated in a connecting part due to leaning of the load of a molten metal container or a difference in thermal expansion between the molten metal container and a ring member.

According to another embodiment of the present invention, the device for supporting molten metal container may stably support a molten metal container even when the molten metal container is alternately rotated in one or the other direction.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Exemplary embodiments of the present invention will now be described in detail with reference to the accompanying drawings.

To help understanding of the present invention in relation to the foregoing features, a device for supporting molten metal container according to embodiments of the present invention will be described in more detail.

Hereinafter, embodiments will be described on the basis of a best mode to understand the technical features of the present invention, and it will be understood that the described embodiments may exemplarily embody the present invention rather than limit the present invention. Therefore, it will be also understood that various modifications of the present invention will be made without departing from the scope of the present invention and such modifications are within the technical scope of the present invention. Further, to help understanding of the embodiments to be described, among elements illustrated on the accompanying drawings, like or similar elements are indicated by like or similar numerals.

The embodiments related to the present invention basically include first and second support units that support the load of a molten metal container alone or together in combination with a ring member enclosing the outside of the molten metal container according to rotation of the molten metal container.

Figure 1:
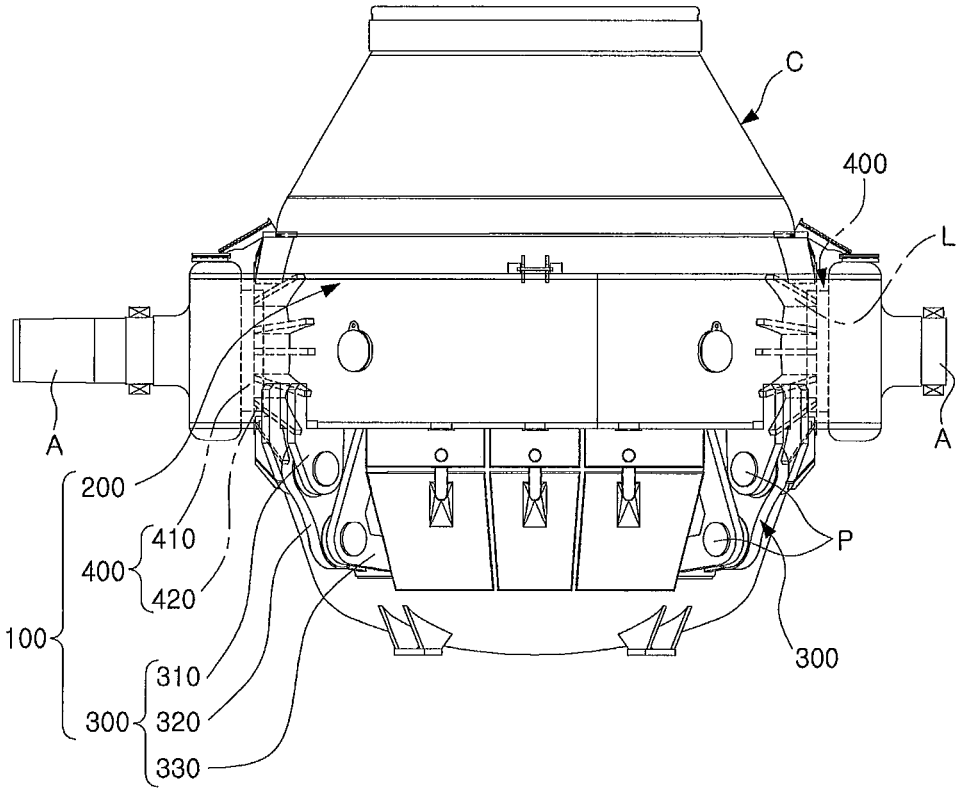
FIG. 1 is a front view of a device for supporting molten metal container according to an embodiment of the present invention.
Figure 2:
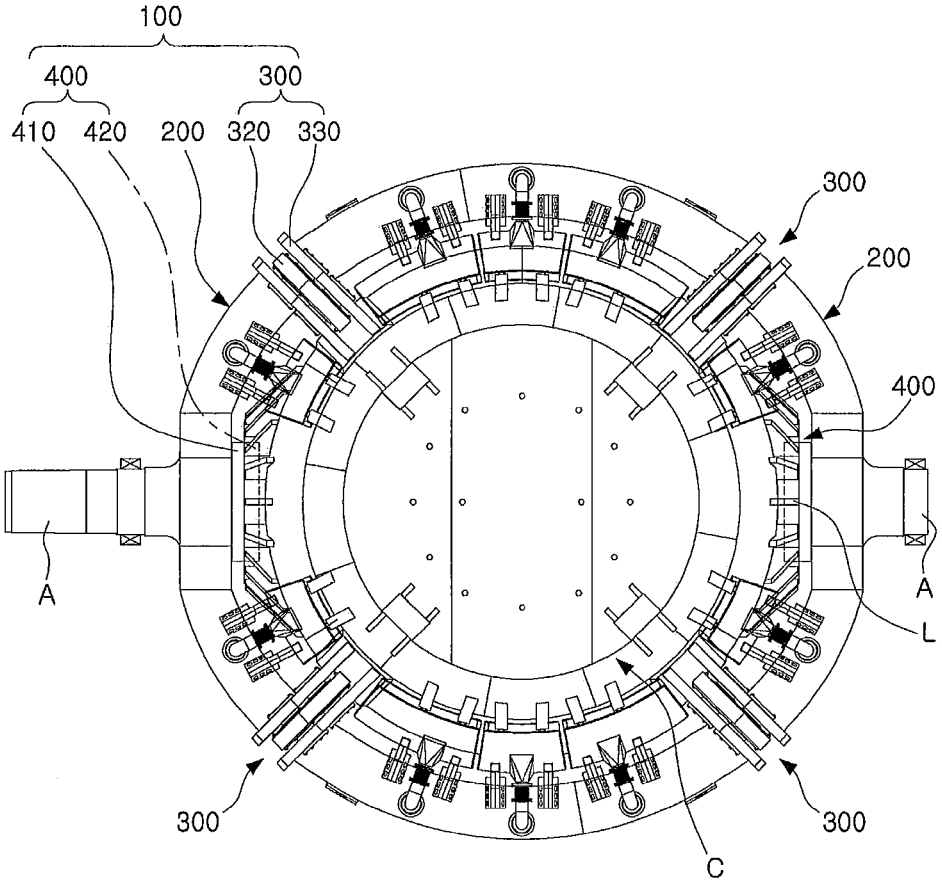
FIG. 2 is a bottom view of a device for supporting molten metal container according to an embodiment of the present invention.

As illustrated in FIGS. 1 and 2, a device for supporting molten metal container according to an embodiment of the present invention may include a ring member 200 and first and second support units 300 and 400.

The ring member 200 may enclose the outside of the molten metal container (C), as illustrated in FIGS. 1 and 2. The molten metal container (C) enclosed by the ring member 200 may be rotated. For this purpose, a rotational shaft (A) is provided in the ring member 200 as illustrated in the drawings. The rotational shaft (A) may be connected to a rotation driving unit (not shown), including, for example, a motor, gears, and the like.

The ring member 200 may support the load of the molten metal container (C) in combination with the first and second support units 300 and 400, as will be described later. As the ring member 200 is rotated about the rotational shaft (A) by an operation of the rotation driving unit, the molten metal container (C) may be rotated about the rotational shaft (A) together with the ring member 200. However, the configuration for rotating the molten metal container (C) is not limited to the illustrated embodiment, but any configuration will be possible if it may rotate the molten metal container (C).

The ring member 200 is also not particularly limited to the illustrated configuration, but may have any configuration if it may support the load of the molten metal container (C) in combination with the first and second support units 300 and 400, as will be described later.

The foregoing molten metal container (C) may be a converter. However, the molten metal container is not limited to the converter but may have any configuration if it may contain molten metal therein.

The first and second support units 300 and 400 may support the load of the molten metal container (C) alone or together in combination with the ring member 200, according to the rotated location of the molten metal container (C). Therefore, the first and second support units 300 and 400 may support the load of the molten metal container (C) without leaning of the load regardless of the rotated positions. Thus, a crack may be prevented from being generated in a connecting part due to leaning of the load of the molten metal container (C).

Figure 6:
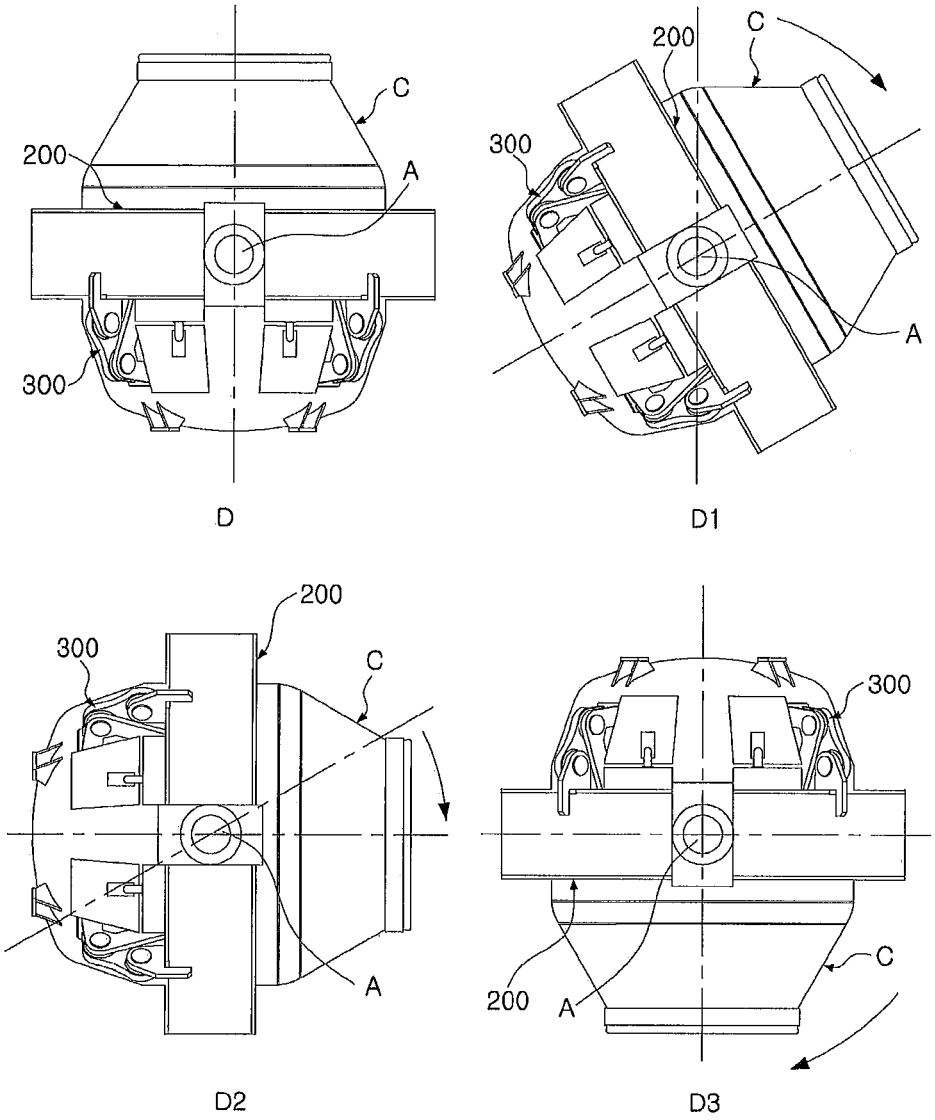
FIGS. 6 and 7 are schematic views explaining operations of a device for supporting molten metal container according to an embodiment of the present invention.
Figure 7:
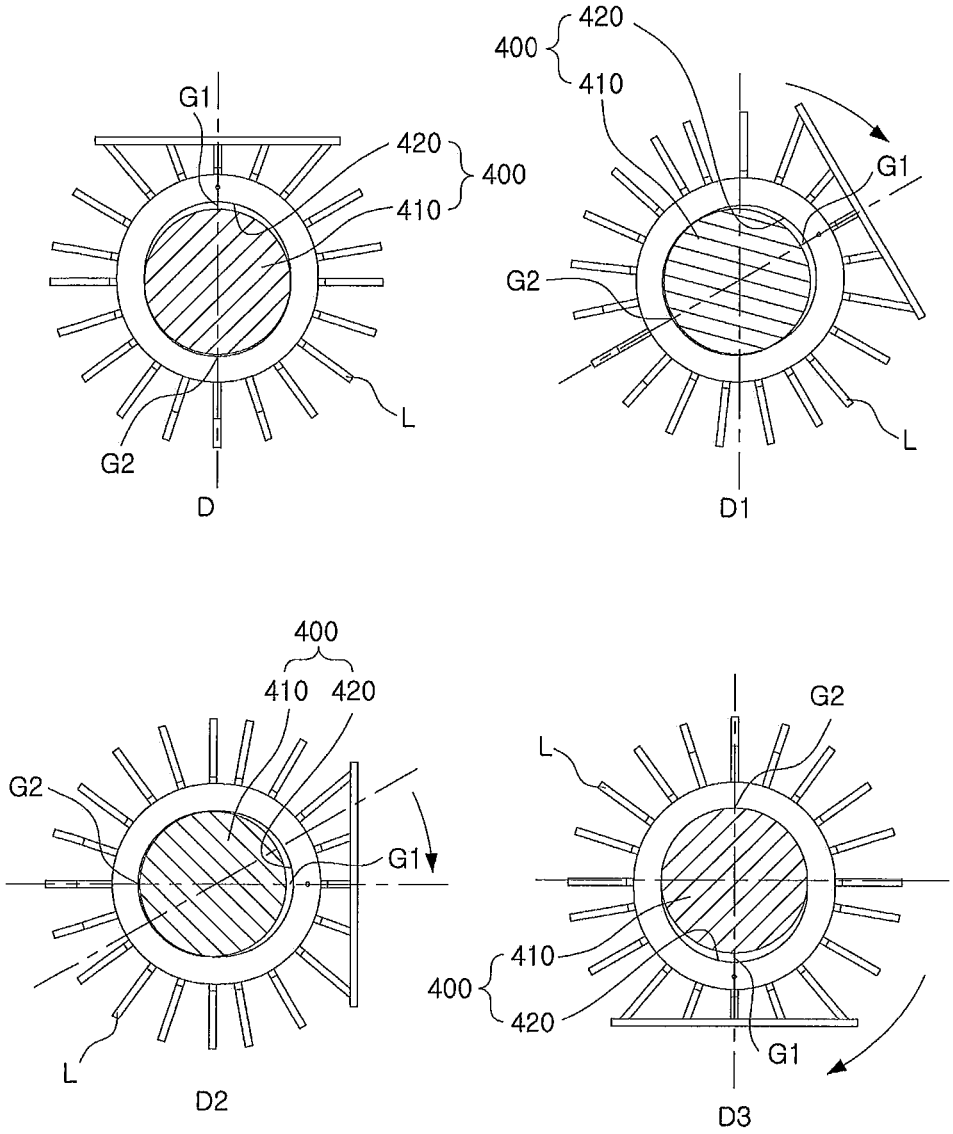
Figure 8A:
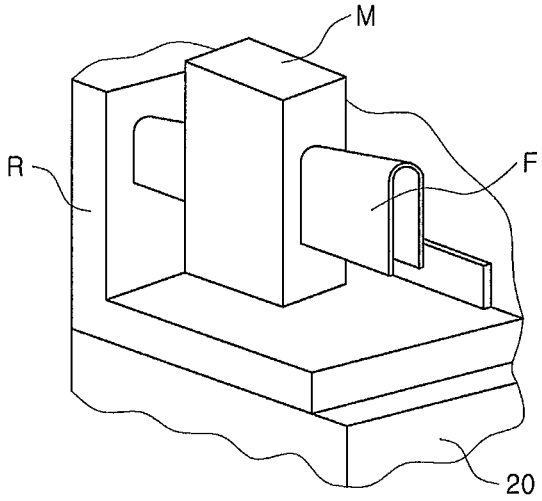
FIG. 8A PRIOR ART
FIGS. 8 and 9 are view illustrating a conventional device for supporting molten metal container.
Figure 8B:
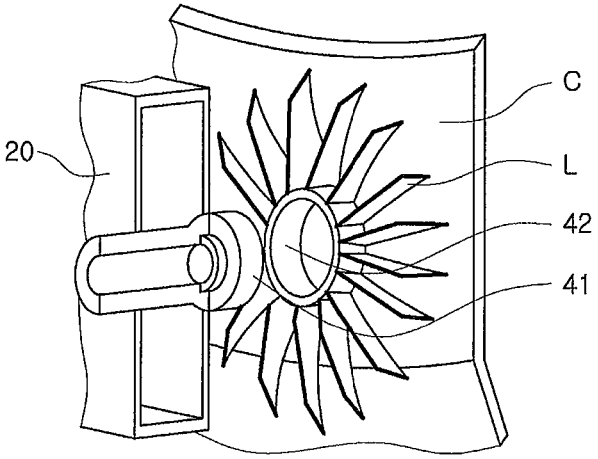
FIG. 8B PRIOR ART
Figure 9A:
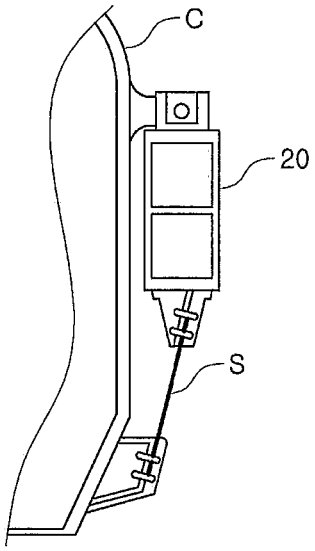
FIG. 9A PRIOR ART
Figure 9B:
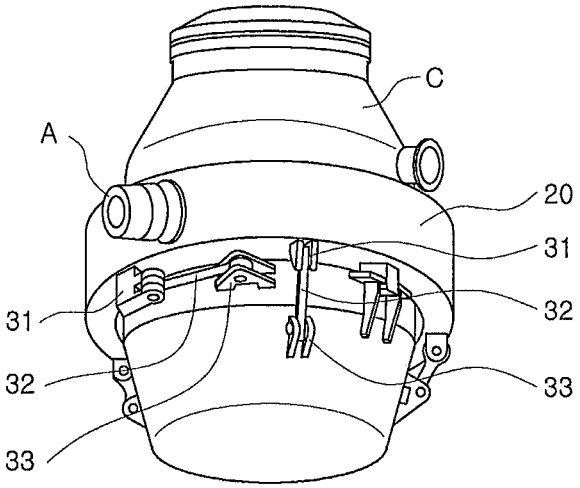
FIG. 9B PRIOR ART

Of the first and second support units 300 and 400, the first support unit 300 may support the load of the molten metal container (C) alone in combination with the ring member 200 from the upright location (D) to a first rotation location (D1) rotated by a predetermined angle from the upright location (D1), as illustrated in FIGS. 6 and 7. The first support unit 300 may support the load of the molten metal container (C) together with the second support unit 400 in combination with the ring member 200 from the first rotation location (D1) to a second rotation location (D2) rotated by 90 degrees from the upright location (D). The first support unit 300 may not support the load of the molten metal container (C) in combination with the ring member 200 from the second rotation location (D2) to the third rotation location (D3) rotated from the second rotation location (D2) by a predetermined angle. From the second rotation location (D2) to the third rotation location (D3), the second support unit 400 may support the load of the molten metal container (C) alone in combination with the ring member 200 as will be described later.

As in an embodiment illustrated in FIG. 2, the first support unit 300 may be four, two disposed equidistantly on one side of the molten metal container (C) about the rotational shaft (A), and the remaining two disposed equidistantly on the other side of the molten metal container (C). Therefore, as previously mentioned, although the molten metal container (C) is rotated in any of the one side direction or the other side direction together with the ring member 200 about the rotational shaft (A), the first support unit 300 may support the load of the molten metal container (C) alone in combination with the ring member 200 from the upright location (D) to the first rotation location (D1), and together with the second support unit 400 in combination with the ring member 200 from the first rotation location (D1) to the second rotation position (D2). Also, the second support unit 400 may support the load of the molten metal container (C) alone in combination with the ring member 200 from the second rotation location (D2) to the third rotation location (D3). Therefore, the molten metal container (c) may be stably supported even when the molten metal container (c) is alternately rotated in one or the other direction. Accordingly, a double slag work which rotates the molten metal container (c), for example, a converter in one side direction or the other side direction to remove slag during blowing may be stably performed.

Figure 3:
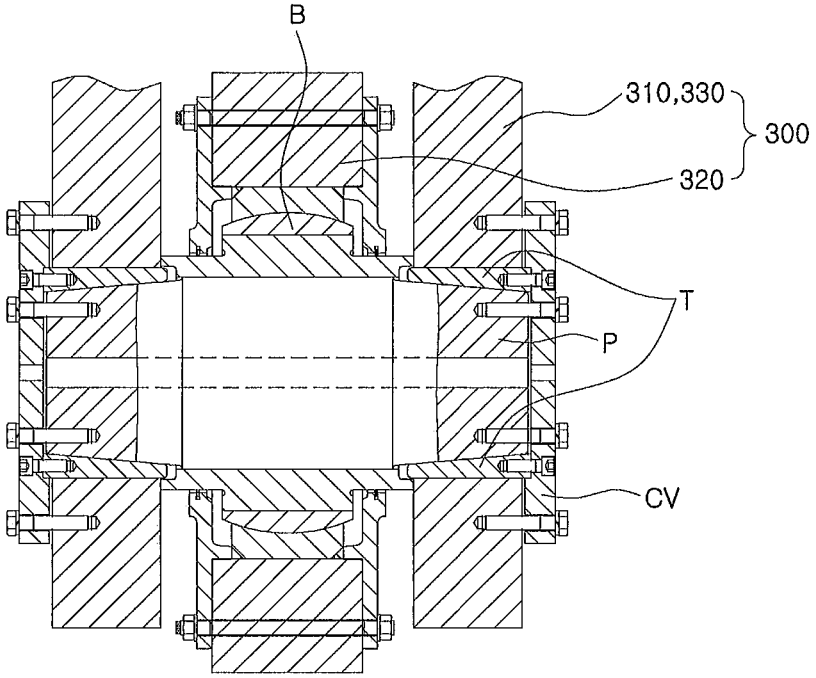
FIG. 3 is a sectional view illustrating a connecting part between a first fixing member or a second fixing member and a link member in a device for supporting molten metal container according to an embodiment of the present invention.

As described above, to support the load of the molten metal container (C) according to the rotated location of the molten metal container (C), the first support unit 300 may include a first fixing member 310, a link member 320, and a second fixing member 330, as in the embodiment illustrated in FIGS. 1 to 3.

As in the embodiment illustrated in FIGS. 1 and 2, the first fixing member 310 may be provided on the ring member 200. The first fixing member 310 is provided on the ring member 200, and it is not particularly limited. Thus, many embodiments are possible as long as the first fixing member 310 is provided on the ring member 200 and connected to the link member 320, as will later be described.

One side of the link member 320 may be connected to the fixing member 310 as in the embodiment illustrated in FIGS. 1 to 4. As in the embodiment illustrated in FIGS. 3 and 4, the first fixing member 310 and the link member 320 may be connected by a pin member (P). A spherical bearing (B) may be provided in a connecting part between the first fixing member 310 and the link member 320. That is, as in the embodiment illustrated, by positioning the spherical bearing (B) between the pin member (P) and the link member 320, the spherical bearing (B) may be provided in the connecting part between the first fixing member 310 and the link member 320. Thus, when the spherical bearing (B) is provided in the connecting part between the first fixing member 310 and the link member 320, although the link member 320 slightly moves in the left or right direction by the load of the molten metal container (C), it is possible to support the molten metal container (C). Also, when a single spherical bearing (B) is provided not between the pin member (P) and the first fixing member 310 but between the pin member (P) and the link member 320, the link member 320 may be prevented from slightly moving to the left or right. In this case, a taper member (T) of which one surface is tapered may be positioned between the pin member (P) and the first fixing member 310, as in the illustrated embodiment.

Figure 4:
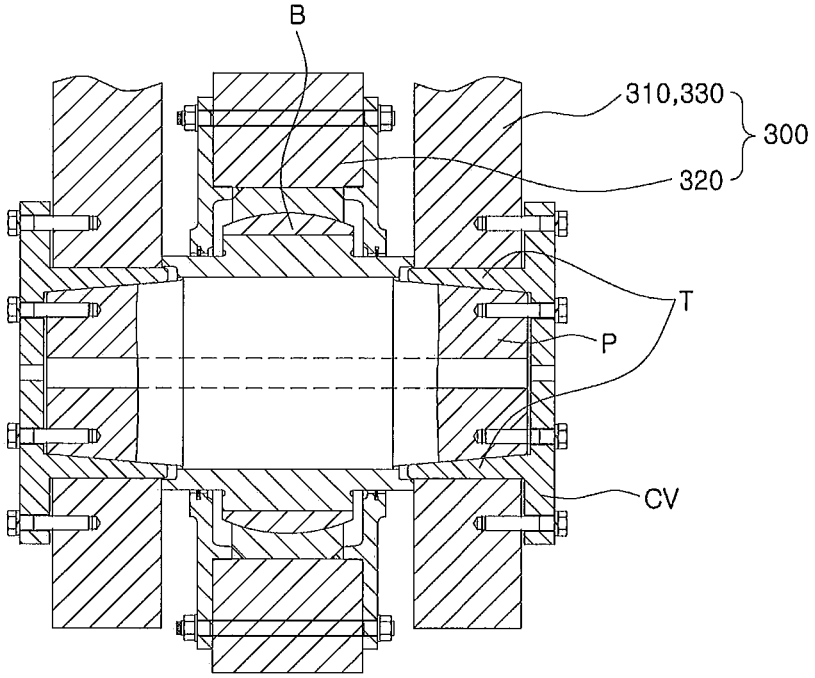
FIG. 4 is a sectional view illustrating a connecting part between a first fixing member or a second fixing member and a link member in a device for supporting molten metal container according to another embodiment of the present invention.

As in the embodiment illustrated in FIGS. 1 and 2, a second fixing member 330 may be provided on the molten metal container (C). The other side of the link member 320 may be connected to the second fixing member 330 as in the illustrated embodiment. As illustrated in FIGS. 3 and 4 and mentioned above, the second fixing member 330 and the link member 320 may be also connected by the pin member (P). Also, by positioning a spherical bearing (B) between the pin member (P) and the link member 320, the spherical bearing (B) may be provided in the connecting part of the second fixing member 330 and the link member 320. Further, a taper member (T) may be positioned between the pin member (P) and the second fixing member 330, as in the illustrated embodiment. Thus, although the link member 320 slightly moves in the left or right direction by the load of the molten metal container (C), it is possible to support the molten metal container (C). The second fixing member 330 is not particularly limited, and many embodiments are possible as long as it may be provided on the molten metal container (C) and may be connected with the link member 320.

Meanwhile, as in the embodiment illustrated in FIG. 3, a cover member (CV) may be connected to the first fixing member 310, the taper member (T) and the pin member (P), or to the second fixing member 330, the taper member (T), and the pin member (P). Thus, the taper member (T) and the pin member (P) may be fixed to normal locations thereof.

Also, the cover member (CV) may be formed integrally with the taper member (T), as in the embodiment illustrated in FIG. 4. Thus, when the cover member (CV) and the taper member (T) are formed in a single body, the taper member (T) may be easily positioned between the pin member (P) and the first fixing member 310 or between the pin member (P) and the second fixing member 330. Also, it is possible to separate the taper member (T) from the location between the pin member (P) and the first fixing member 310, or between the pin member (P) and the second fixing member 330.

Thus, the connection and separation between the first fixing member 310 and the link member 320 and between the second fixing member 330 and the link member 320 may be easily performed.

As illustrated in FIGS. 6 and 7, the second support unit 400 may not support the load of the molten metal container (C) in combination with the ring member 200 from the upright location (D) to the first rotation location (D1) rotated by a predetermined angle from the upright position (D). From the upright location (D) of the molten metal container (C) to the first rotation location (D1), the first support unit 300 may support the load of the molten metal container (C) in combination with the ring member 200 as described above. The second support unit 400 may support the load of the molten metal container (C) together with the first support unit 300 in combination with the ring member 200 from the first rotation location (D1) to the second rotation location (D2) rotated by 90 degrees from the upright location (D). Also, from the second rotation location (D2) to the third rotation location (D3) rotated from the second rotation location (D2) by a predetermined angle, the second support unit 400 may support the load of the molten metal container (C) in combination with the ring member 200.

Figure 5:
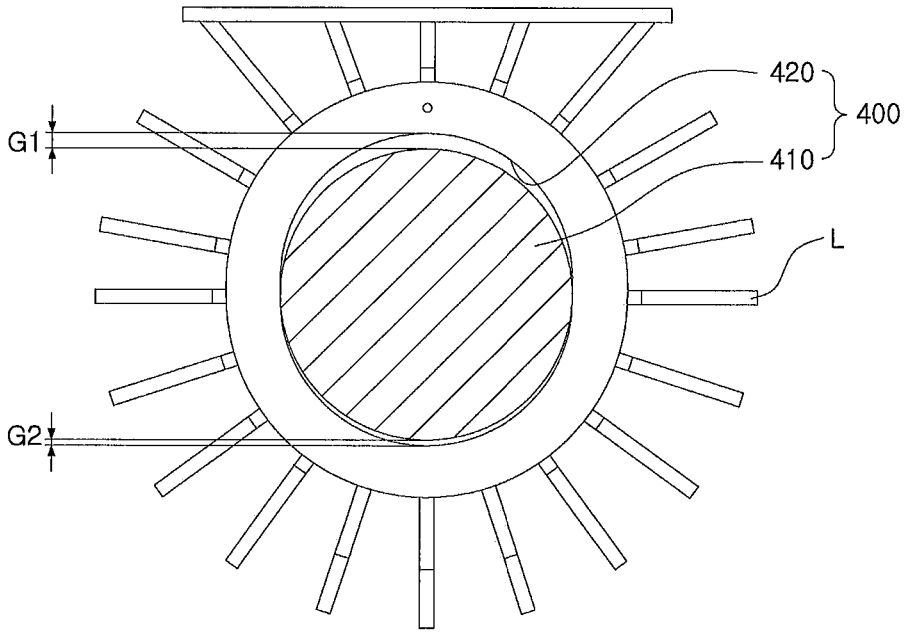
FIG. 5 is an enlarged sectional view of a second support unit in a device for supporting molten metal container according to an embodiment of the present invention.

For this purpose, the second support part 400 may include a support member 410 and an insertion hole 420, as illustrated in FIGS. 1, 2 and 5.

As illustrated in FIGS. 1, 2 and 5, the support member 410 is provided on the ring member 200. As in the illustrated embodiment, the support member 410 may be provided on an opposite side to the rotational shaft (A) provided on the ring member 200, i.e., within the ring member 200. Also, like the rotational shaft (A), the ring member 200 may be provided with two support member 410. The support member 410 is not particularly limited, and anything will be possible if it may be provided on the ring member 200.

The insertion hole 420 may be formed in the molten metal container (C) as in the embodiment illustrated in FIGS. 1, 2 and 5. One side of the foregoing support member 410 may be inserted into the insertion hole 420 as in the illustrated embodiment. Therefore, as previously mentioned, the load of the molten metal container (C) may be supported by one side of the support member 410 inserted into the insertion hole 420 according to the rotated location of the molten metal container (C).

Meanwhile, as in the embodiment illustrated in FIG. 5, a first clearance (G1) and a second clearance (G2) may be formed between the support member 410 and the insertion hole 420. The second clearance (G2) may be formed on an opposite side to the first clearance (G1) as in the illustrated example. The first clearance (G1) and the second clearance (G2) may be positioned above and below the insertion hole 420 at the upright location of the molten metal container (C), as in the embodiment illustrated in FIG. 5. Therefore, at the upright location (D) of the molten metal container (C), the load of the molten metal container (C) is not supported by the support member 410 of the second support unit 400. Thus, as previously mentioned, the first support unit 300 may support the load of the molten metal container (C) alone in combination with the ring member 200. Also, from the upright location (D) of the molten metal container (C) to the first rotation location (D1), i.e., a rotation location where the support member 410 first contacts the insertion hole 420 by rotation of the molten metal container (C) and the ring member 200 as illustrated in FIGS. 6 and 7, the first support unit 300 may support the load of the molten metal container (C) alone in combination with the ring member 200, as described above. The first support unit 300 and the second support unit 400 may support the load of the molten metal container (C) together in combination with the ring member 200 from the first rotation location (D1) to the second rotation location (D2). That is, according to the rotation of the molten metal container (C), the load of the molten metal container (C) may be transferred from the first support unit 300 to the second support unit 400. Also, since the load of the molten metal container (C) is not supported by the first support unit 300 from the second rotation location (D2) to the third rotation location (D3), the second support unit 400 may support the load of the molten metal container (C) alone in combination with the ring member 200.

As in the embodiment illustrated in FIG. 5, the first clearance (G1) and the second clearance (G2) formed between the support member 410 and the insertion hole 420 may prevent generation of a crack at the connecting part, such as the support member 410, the insertion hole 420, and the like due to a difference in thermal expansion between the molten metal container (C) and the ring member 200 made of different materials. Also, the first clearance (G1) may be greater than the second clearance (G2) as in the illustrated example. Thus, when the first clearance (G1) is greater than the second clearance (G2), the support member 410 may be easily assembled into the insertion hole 420. The sizes of the first clearance (G1) and the second clearance (G2) are not particularly limited, and any size thereof may be possible if as described above, the first support unit 300 supports the load of the molten metal container (C) alone in combination with the ring member 200 from the upright location (D) to the first rotation location (D1), the first support unit 300 and the second support unit 400 support the load of the molten metal container (C) in combination with the ring member 200 from the first rotation location (D1) to the second rotation location (D2), the second support unit 400 support the load of the molten metal container (C) in combination with the ring member 200 from the second rotation location (D2) to the third rotation location (D3), and such sizes may prevent generation of a crack at the support member 410 and the insertion hole 420 due to a difference in thermal expansion between the molten metal container (C) and the ring member 200 made of different material.

Meanwhile, as in the embodiment illustrated in FIGS. 1, 2 and 5, ribs (L) may be provided by the insertion hole 420 so as to support the load of the molten metal container (C).

Hereinafter, operations of the device for supporting molten metal container 100 according to an embodiment of the present invention will be described with reference to FIGS. 6 and 7.

First, as illustrated in FIGS. 6 and 7, at the upright location (D) of the molten metal container (C), the first clearance (G1) and the second clearance (G2) between the support member 410 of the second support unit 400 and the insertion hole 420 are positioned at the upper side and the lower side of the insertion hole 420, respectively. Thus, in this case, the first support unit 300 supports the load of the molten metal container (C) alone in combination with the ring member 200.

Also, the support member 410 does not contact the insertion hole 420 thanks to the first clearance (G1) and the second clearance (G2) to the first rotation location (D1) where the molten metal container (C) and the ring member 200 are rotated in one direction or the other direction and thus the support member 410 of the second support unit 400 first contacts the insertion hole 420. Therefore, from the upright location (D) of the molten metal container (C) to the first rotation location (D1), the first support unit 300 supports the load of the molten metal container (C) alone in combination with the link member 200.

Further, the molten metal container (C) is further rotated together with the ring member 200 in one direction or the other direction from the first rotation location (D1), and as illustrated in FIGS. 6 and 7, the rotated angle of the molten metal container (C) is less than 90 degrees to the second rotation location (D2) even while the support member 410 contacts the insertion hole 420. Therefore, as described above, the first support unit 300 and the second support unit 400 support the load of the molten metal container (C)

together in combination with the ring member 200. That is, the load of the molten metal container (C) applied to the first support unit 300 is transferred to the second support unit 400.

When the molten metal container (C) is rotated to the second rotation location (D2), the first support unit 300 does not support the load of the molten metal container (C) in combination with the ring member 200. Thus, in this case, the second support unit 400 supports the load of the molten metal container (C) in combination with the ring member 200.

Also, to the third rotation location (D3) where the molten metal container (C), for example, a converter is further rotated together with the ring member 200 in one direction or the other direction, and molten metal contained in the converter is released, the rotated angle of the molten metal container (C) from the upright location (D) exceeds 90 degrees. Thus, in this case, the first support unit 300 does not support the load of the molten metal container (C) in combination with the ring member 200. However, in this case, the support member 410 of the second support unit 400 contacts the insertion hole 420 by self weight of the molten metal container (C), as illustrated in FIGS. 6 and 7. Therefore, from the second rotation location (D2) to the third rotation location (D3), the second support unit 400 supports the load of the molten metal container (C) alone in combination with the ring member 200.

Meanwhile, although the molten metal container (C) is rotated about the rotational shaft (A) alternately in one direction or the other direction, the first support unit 300 and the second support unit 400 stably support the load of the molten metal container (C) alone or together in combination with the ring member 200 according to the rotated location (D, D1, D2, D3), as described above.

As described above, by using the device for supporting molten metal container according to the present invention, the load of the molten metal container may be supported by a single support unit or two support units in combination with the ring member according to the rotated location, and thus the load of the molten metal container may be stably supported without leaning of the load of the molten metal container regardless of the rotated location of the molten metal container, and leaning of the load of the molten metal container or a crack may be prevented from being generated in a connecting part or the like due to a difference in thermal expansion between the molten metal container and the ring member, and although the molten metal container is alternately rotated in one direction or the other direction, the molten metal container may be stably supported.

The aforementioned device for supporting molten metal container is not limited to the configurations of the aforesaid embodiments, but all or parts of the embodiments may be selectively combined with each other so as to form various modifications.

While the present invention has been shown and described in connection with the exemplary embodiments, it will be apparent to those skilled in the art that modifications and variations can be made without departing from the spirit and scope of the invention as defined by the appended claims.

The invention claimed is:

1. A device for supporting a molten metal container comprising:

a ring member enclosing an outside of a rotatable molten metal container; and first and second support units configured to support a load of the molten metal container alone or together in combination with the ring member, according to the rotated locations of the molten metal container, wherein the second support unit comprises:

a support member provided on the ring member; and an insertion hole formed in the molten metal container such that one side of the support member is inserted, wherein a first clearance and a second clearance formed at an opposite side to the first clearance are formed between the support member and the insertion hole, and the first clearance and the second clearance at the upright location of the molten metal container are positioned on an upper side and a lower side of the insertion hole, respectively.

2. A device for supporting a molten metal container comprising:

a ring member enclosing an outside of a rotatable molten metal container; and first and second support units configured to support the load of the molten metal container alone or together in combination with the ring member, according to the rotated locations of the molten metal container, wherein the second support unit comprises:

a support member provided on the ring member; and an insertion hole formed in the molten metal container such that one side of the support member is inserted, wherein a first clearance and a second clearance formed at an opposite side to the first clearance are formed between the support member and the insertion hole, and the first clearance and the second clearance at the upright location of the molten metal container are positioned on an upper side and a lower side of the insertion hole, respectively, and wherein the first support unit supports the load of the molten metal container alone in combination with the ring member from an upright location to a first rotation location rotated by a predetermined angle from the upright location, the first support unit supports the load of the molten metal container together with the second support unit in combination with the ring member from the first rotation location to a second rotation location rotated by 90 degrees from the upright location, and the second support unit supports the load of the molten metal container, alone in combination with the ring member from the second rotation location to a third rotation location rotated from the second rotation location by a predetermined angle.

3. The device for supporting the molten metal container of claim 2, wherein a rotational shaft is provided in the ring member, the molten metal container is rotated about the rotational shaft together with the ring member.

4. The device for supporting the molten metal container according to claim 2, wherein the first support unit comprises:

a first fixing member provided in the ring member;

a link member of which one side is connected to the first fixing member; and a second fixing member provided on the molten metal container and connected with the other side of the link member.

5. The device for supporting the molten metal container of claim 4, wherein a spherical bearing is provided in a connecting part between the first fixing member and the link member, or to a connecting part between the link member and the second fixing member.

6. The device for supporting the molten metal container of claim 4, wherein the first fixing member and one side of the link member or the other side of the link member and the second fixing member are connected by a pin member, and, a taper member is positioned between the first fixing member and the pin member or between the second fixing member and the pin member.

7. The device for supporting the molten metal container of claim 6, wherein the taper member is formed integrally with a cover member connected to the first fixing member and the pin member or the second fixing member and the pin member.

8. The device for supporting the molten metal container of claim 2, wherein the first clearance is greater than the second clearance.

* * * * *